US005128639A

United States Patent [19]

Ueda et al.

[11] Patent Number: 5,128,639

[45] Date of Patent: Jul. 7, 1992

[54] PHASE SHIFTER UTILIZING HYBRID ELEMENT

[75] Inventors: Hiroyuki Ueda, Kasugai; Takatoshi Kato, Aichi; Yuichi Tanaka, Owariasahi, all of Japan

[73] Assignee: Kabushiki Kaisha Toyota Chuo Kenkyusho, Aichi, Japan

[21] Appl. No.: 698,079

[22] Filed: May 10, 1991

[30] Foreign Application Priority Data

May 16, 1990 [JP] Japan ..... 2-126445

[51] Int. Cl.[5] ..... H01P 9/00

[52] U.S. Cl. ..... 333/164; 333/156; 333/161

[58] Field of Search ..... 333/164, 156, 161, 246, 333/157, 140, 238, 239, 103, 150, 26, 139

[56] References Cited

U.S. PATENT DOCUMENTS 5,032,806 7/1991 Nakahara ..... 333/161

FOREIGN PATENT DOCUMENTS 59-51602 3/1984 Japan .
63-123202 5/1988 Japan .
1-218102 8/1989 Japan .

*Primary Examiner*—Eugene R. LaRoche
*Assistant Examiner*—Ali Neyzari
*Attorney, Agent, or Firm*—Oblon, Spivak, McClelland, Maier & Neustadt

[57] ABSTRACT

A hybrid element for phase shifting an input signal and providing a phase shifted output signal includes conductive plates which are capacitive coupled together. The hybrid element includes four terminals: an input terminal for receiving an input signal, an isolation terminal capacitive coupled with the input terminal and for providing an output signal, a through terminal connected directly with the input terminal, and a coupling terminal capacitive coupled with the input terminal. A distributed constant line and an FET are connected in pair with the through and coupling terminals, respectively, the other end of the distributed constant line being connected with earth. When the FET is turned on or off, the amount of phase shift in the phase shifter is controlled. Since the FET and distributed constant line are connected together in parallel, the amount of phase shift can be adjusted easily by turning the FET on or off.

9 Claims, 17 Drawing Sheets

PHASE SHIFTER UTILIZING HYBRID ELEMENT

BACKGROUND OF THE INVENTION

1. Field of the Invention

The present invention relates to a phase shifter for shifting a signal in phase and particularly to a hybrid type phase shifter.

2. Description of the Related Art

In the past, various type phase shifters have been used. They are important with development of electrical communication.

For example, satellite communication requires an antenna for tracking a satellite. Particularly, a satellite tracking antenna which is mounted on a moving objects such as motorcar or the like is required to be reduced in size and electric power consumption. It is thus believed that the satellite tracking antenna on the moving object is perferably a phased array antenna. The phased array antenna is required to control the phase for each of antenna elements which form an array. Therefore, the phase shifter becomes one of very important components for the phased array antenna.

Phase shifters which are used in such a phased array antenna and the like include digital phase shifters which are adapted to change the amount of phase shift from one to another by on-off controlling a switch. The digital phase shifters are known to be of loaded line type, switched line type, hybrid type and so on. Among them, the hybrid type phase shifter is preferred since it has a relatively simple structure for providing any amount of phase shift.

On the other hand, the digital phase shifters utilize a switch for selecting the amount of phase shift, which may be a diode type or field effect transistor (FET) type switch. FET type is believed to be particularly suitable for use in such an antenna as mounted on the moving object such as motorcar or the like, since the FET type switch has a necessary power lower than that of the diode type switch on the order of several figures and may include a simplified bias circuit without any capacitor for cutting off DC.

In other word, antenna systems on motorcars or other moving objects require an electrical power consumption as low as possible since the limited capacity of battery must be effectively utilized. The antenna systems, which are used in the motorcars or other moving object, must be of a construction as simple as possible since they are used under severe conditions such as vibrations associated with the running vehicles, intensive changes of temperature and so on.

It is therefore preferred that a hybrid type phase shifter having a FET switch is used as a phase shifter mounted on the moving object.

On example of the conventional hybrid phase shifters with a switch for selecting the amount of phase shift is shown in FIG. 17. The hybrid phase shifter comprises a three dB hybrid element 10 in which an input signal is divided into two output signals of equivalent magnitude, and two phase shift regulating circuits 12.

The hybrid element 10 includes an input terminal 10*a* receiving an input signal and an isolation terminal 10*b* providing an output signal. The hybrid element 10 also includes a coupling terminal 10*c* and a through terminal 10*d*. The two phase shift regulating circuits 12 are connected with the coupling and through terminals 10*c*, 10*d* in the hybrid element 10.

The two phase shift regulating circuits 12 are of the same construction which comprises a first line 12*a* having one opened end and a second line 12*b* cascade connected between the other end of the first line 12*a* and a switch 12*c*.

The functional principle of this phase shifter will be described in connection with FIG. 18 which is a Smith chart.

There is first considered the reflection coefficient Γ in the switch 12*c*, which is one viewed from a reference plane C to the switch side. Ideally, the reflection coefficient Γ is equal to −1 when the switch 12*c* is ON and equal to one when the switch 12*c* is OFF. If the switch 12*c* is of FET type, however, it includes an induction component and a capacity component. As shown in FIG. 18, thus, the reflection coefficient Γ is in a position Γ Con which is substantially equal to −1 and shifted clockwise due to the induction component if the switch 12*c* is ON. On the other hand, if the switch 12*c* is OFF, the reflection coefficient Γ is in another position Γ Coff which is substantially equal to one and shifted clockwise due to the capacity component.

It is secondly considered the reflection coefficient Γ which is viewed from a reference plane D including the second line 12*b* (characteristic impedance Z0) to the switch side. If the characteristic impedance of the line 12*b* is equal to 50 Ω, the reflection coefficient Γ is in the respective positions Γ Don and Γ Doff when the switch 12*c* is ON and OFF. in which positions the reflection coefficient Γ in the reference plane C is rotated to the side of power source (clockwise) by the electrical length of the line 12*b* while maintaining its magnitude constant.

It is further considered the reflection coefficient Γ which is viewed from a reference plane E including the first line 12*a*. The reference coefficient Γ is rotated on a constant conductance circle toward the side of power source (clockwise) to a position Γ Eon or Γ Eoff in either time when the switch 12*c* is ON or OFF. In other words, the reflection coefficient Γ viewed from the reference plane E when the switch 12*c* is ON and OFF is rotated on the constant conductance circle which is determined depending on the position of the reflection coefficient Γ viewed from the reference plane D.

Therefore, the reflection coefficient Γ on ON and OFF in the switch 12*c* can be determined by varying the first and second lines 12*a*, 12*b* in length and other parameters. As a result, a difference $\phi$ between phases when the switch 12*c* is ON and OFF becomes the amount of phase shift at the output terminal 10*b*. When the switch is turned on or off, the amount of phase shift in the phase shifter can be changed from one to another by setting the first and second line 12*a*, 12*b* at predetermined lengths.

However, the aforementioned phase shifter constructed in accordance with the prior art has the following problems:

(A) The amount of phase shift can be set only by adjusting both the first and second lines 12*a*, 12*b*. This adjustment is very difficult. More particularly, the adjustment of the reflection coefficient Γ on the constant conductance circle by regulating the length of the first line 12*a* should be combined with the adjustment of the length of the second line 12*b*. It is extremely difficult to find a proper combination of length between the first and second lines 12*a*, 12*b*.

(B) Generally, the FET switch has less property in its ON state than that of the OFF state. This fact is not well considered in the conventional phase shifter as described. Thus, the phase shifter will have a loss substantially increased from that of the OFF state. Such an increased difference of loss between the ON and OFF states of the phase shifter is very detrimental for the application of the aforementioned phased array antenna.

(C) Although the functional principle of the prior art has been described as to a single frequency, it must be measured throug the entire frequency band actually used therein. The aforementioned phase shifter has a possibility in which the frequency band is extremely narrowed depending on the case. It is very difficult to find under what condition the frequency band can be widened. Although some other configurations in addition to the aforementioned phase shifter are known in the art, none of them could overcome the above three problems and set any desired amount of phase shift.

In order to overcome all the problems in the prior art, an object of the present invention is thus to provide a digital phase shifter which can set any desired amount of phase shift very simply.

SUMMARY OF THE INVENTION

In accordance with the present invention, as shown in FIG. 1, a phase shifter comprises a hybrid element 20 for receiving an input signal and outputting a phase shifted signal, a switch **22*b* connected with the hybrid element 20 and adapted to provide a given shift to the phase, and a distributed constant line 22*a* connected in parallel with the switch 22*b* and having a preselected characteristic impedance. The phase shifter is adapted to shift the phase of the output signal by turning the switch 22*b*** on or off.

The distributed constant line **22*a* may be a microstrip line structure comprising a dielectric plate 14, a ground conductive surface 16 on one side of the dielectric plate 14 and a conductive line 18 on the other side of the dielectric plate 14, as shown in FIG. 19. Alternatively, the distributed constant line 22*a* may be a tri-plate strip line structure comprising a dielectric plate 14, ground conductive surfaces 16 on the opposite sides of the dielectric plate 14 and a conductive line 18 inserted into the interior of the dielectric plate 14**.

In such a manner, the present invention provides the switch **22*b* connected in parallel with the distributed constant line 22*a*. By varying the length of the distributed constant line 22*a* in the range of 0 to $\lambda/4$, therefore, the reflection coefficient $\Gamma$ as viewed from the reference plane B to the switch side can be changed from a short circuit $\Gamma=-1$ to a value corresponding to that obtained when only the switch 22*b* is provided. Only by varying the length of the distributed constant line 22*a*, thus, a difference of phase between the ON and OFF states in the switch 22*b*, that is, an amount of phase shift in the phase shifter can be set at any proper level. If the distributed constant line 22*a* is connected in parallel with the switch 22*b*, the reflection coefficient can be increased when the switch 22*b* is in its ON state. Even if the switch 22*b* is of FET type having less ON characteristic than OFF characteristic, the loss in the switch 22*b* when it is turned on can be decreased to reduce a differential loss between the ON and OFF states in the switch 22*b***. This decreases any limitation for the application of the phase shifter.

If the width of the distributed constant line **22*a* is decreased, the characteristic impedance thereof can be increased. The increased characteristic impedance in the distributed constant line 22*a* provides less influence to the amount of phase shift in the phase shifter. Thus, if the phase shifter is applied to a signal having a frequency of about 5GHz and when the distributed constant line 22*a*** has a high characteristic impedance exceeding 50Ω, the phase shifter can have a sufficiently increased specific band width.

In accordance with the present invention, the lower limit of the band width can be determined not to decrease the band width extremely.

If the switch **22*b*** is of FET type with any resistance located in a line between the gate thereof and the bias terminal, the impedance viewed from the drain to the gate can be increased. Thus, a high frequency wave leaking from the drain of the FET to the gate thereof can be reflected to reduce any loss when the FET is turned off.

In the phase shifter constructed according to the present invention, a signal inputted to the hybrid element 20 through the input terminal **20*a* is phase shifted and outputted from the output terminal 20*b***. The phase in the output signal can be varied by turning the switch on or off.

In accordance with the present invention, the amount of phase shift determined by turing the switch **22*b* on or off can be very efficiently set. The adjustment of the phase shift will be described below with reference to FIG. 2** which illustrates a reflection coefficient.

There is first considered a reflection coefficient $\Gamma$ in the switch **22*b* (e.g. FET) when viewed from the reference plane A to the switch side. As in the prior art mentioned above, the reflection coefficient $\Gamma$ is brought into positions $\Gamma$ Aon and $\Gamma$ Aoff respectively having inductive and capacitive components near $-1$ and 1 depending on the ON an OFF states of the switch 22*b***.

If the length of the distributed constant line **22*a* is equal to zero, this means that a short-circuiting occurs at the top end of the switch 22*b*. Thus, the reflection coefficient $\Gamma$ must be in a position $\Gamma=-1$, irrrespective of the state of the switch 22*b***.

There is next considered a reflection coefficient $\Gamma$ Bon viewed from the reference plane B to the switch side if an FET type switch **22*b* is connected in parallel with the distributed constant line 22*a* and when the switch 22*b*** is turned on.

This can be conveniently illustrated by an admittance chart. When the switch **22*b* viewed from the reference plane B to the switch side is turned on, an admittance YBon (=1/ZBon) can be represented below. Now assume that an admittance between the source and drain of the FET switch 22*b* in its ON state is Yon and the characteristic admittance in the distributed constant line 22*a*** having its length d is Y00.

$$YBon = Yon - jY00 \cot(2\pi d/\lambda)$$

Further assuming that the characteristic admittance Y00(=1/Z00) is (1/50)S, the reflection coefficient $\sigma$ Bon as viewed from the reference plane B to the switch side is:

$$\Gamma Bon = (1 - YBon)/(1 + YBon)$$

Thus, the reflection coefficient $\Gamma$ Bon as viewed from the reference plane B to the switch side will move from the reflection coeficient $\Gamma$ Aon determined by an admittance Yon in the switcg **22*b*** to a point $\Gamma=-1$ along a constant conductance circle determined by a conductance component of Yon = 1/Zon, that is, a circle passing through the points Γ Bon and Γ = −1and having its center on a straight line connecting the points Γ = 1 and Γ = −1, by sequentially decreasing the length of the distributed constant line from d = λ/4.

On the other hand, the reflection coefficient Γ Boff of the switch 22b as viewed from the reference plane B to the switch side when the switch 22b is turned off will move from the value Γ Boff determined by an admittance in the OFF state of the switch 22b to the point Γ = −1 along a constant conductance circle determined by the above admittance as in the ON state of the switch 22b when the length of the distributed constant line 22a decreases from λ/4 to zero. Since the amount of phase shift in the phase shifter is determined by a differential phase between the ON and OFF states of the switch 22b, any desired amount of phase shift can be obtained only by varying the length d of the distributed constant line 22a.

As described above, the phase shifter of the present invention can adjust the amount of phase shift only by regulating the length of the distributed constant line. Thus, the adjustment can be performed to provide any desired amount of phase shift in a simple and accurate manner. Since the adjustment of phase shift increases the reflection coefficient in the switch when turned on, the loss on the ON state of the switch can be reduced. Even if the switch is of FET type having a high resistance on its ON state, the phase shifter can provide less loss on the state of the switch.

DETAILED DESCRIPTION OF PREFERRED EMBODIMENTS

Figure 3:
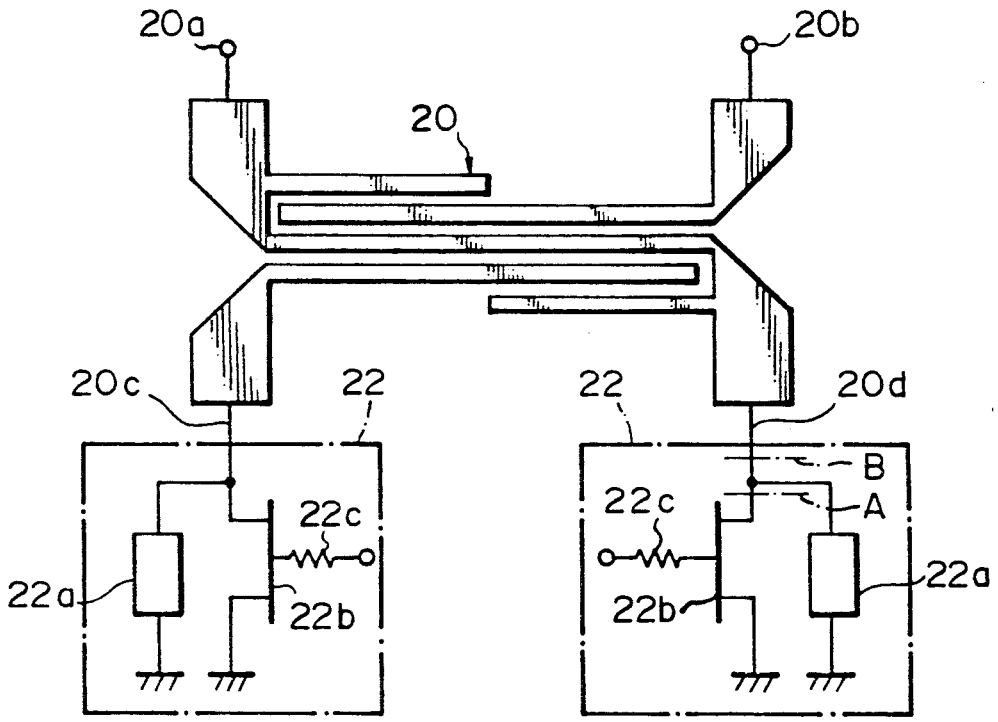
FIG. 3 is a block diagram illustrating the basic construction of a range coupler used in the present invention as a hybrid element.
Figure 4:
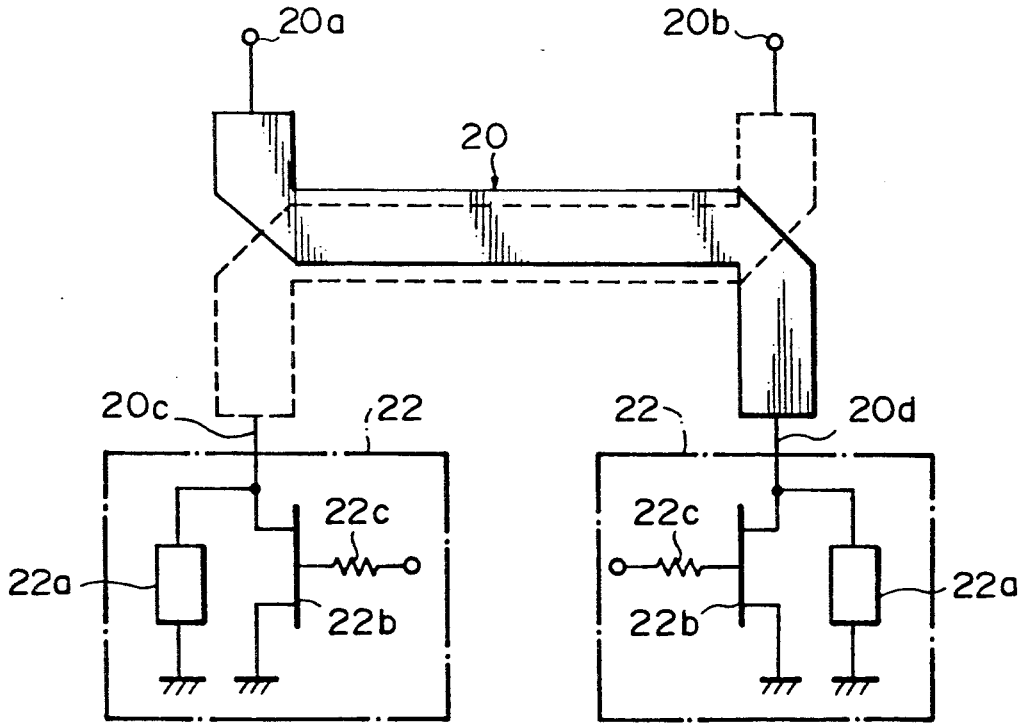
FIG. 4 is a block diagram illustrating the basic construction of a broad side offset coupler used in the present invention as a hybrid element.

Referring to FIGS. 3 and 4, there are shown hybrid elements 20 each of which comprises an input terminal 20a, an output terminal 20b, a coupling terminal 20c and a through terminal 20d. The hybrid element 20 shown in FIG. 3 is a range coupler including comb-shaped microstrip lines which are arranged close to each other and capacitive-coupled with each other. The hybrid element 20 shown in FIG. 4 is a broad side offset coupler including two tri-plate lines which are arranged one above another and capacitive coupled with each other.

Phase shift regulating circuits 22 are connected respectively with the coupling and through terminals 20c, 20d of each hybrid element 20.

Each of the phase shift regulating circuits 22 comprises a distributed constant line 22a having a characteristic impedance exceeding 50Ω and an FET switch 22b which has a gate connected with a resistance 22c. In such an arrangement, a signal applied to the input terminal 20a is divided and directed into the terminals 20c and 20d through the hybrid element 20. After the signals outputted from the terminals 20c and 20d have been phase shifted respectively by the phase shift regulating circuit 22, they are combined with each other and taken out of the respective output terminals 20b.

The amount of phase shift is determined by changes of impedance in the circuit comprising the distributed constant line 22a and the FET switch 22b, which appear when the FET switch 22b is turned on and off. A differential phase between the ON and OFF states of the FET switch 22b can be set at any desired level by suitably varying the length of the distributed constant line 22a as shown by the Smith chart of FIG. 2.

In such a manner, the amount of phase shift can be set very simply and accurately.

Figure 2:
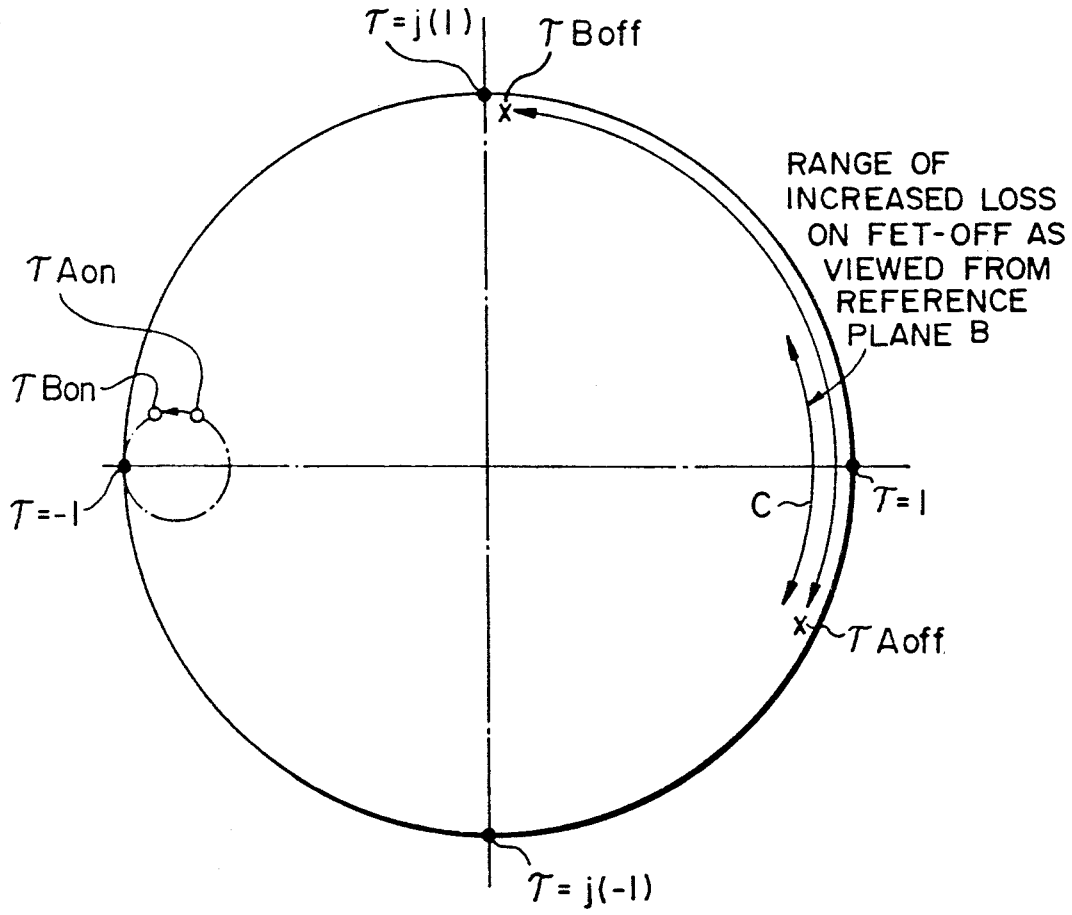
FIG. 2 is a characteristic diagram illustrating the principle of the adjustment of phase shift in the phase shifter.
Figure 5:
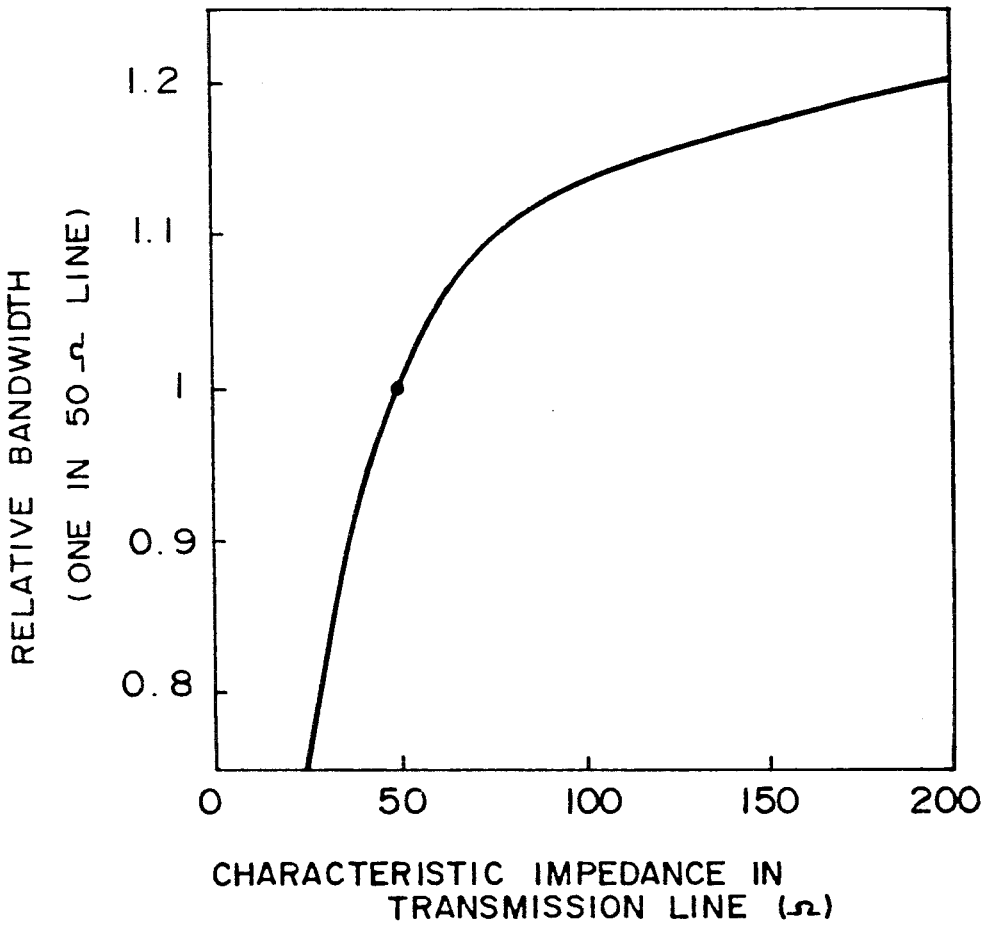
FIG. 5 is a characteristic diagram illustrating the relationship between a characteristic impedance and a frequency band width in a distributed constant line.

The relationship between the characteristic impedance and the frequency band width in the distributed constant line 22a when this phase shifter is used as a 90° phase shifter for a differential phase equal to 90° as shown in FIG. 2 is illustrated in FIG. 5. In this case, the band width in which the amount of phase shift deviates by 10° due to the change of signal frequency is defined as a frequency band. The change of the band width is represented relative to a reference condition in which the characteristic impedance of the distributed constant line 22a is equal to 50 Ω.

Figure 1:
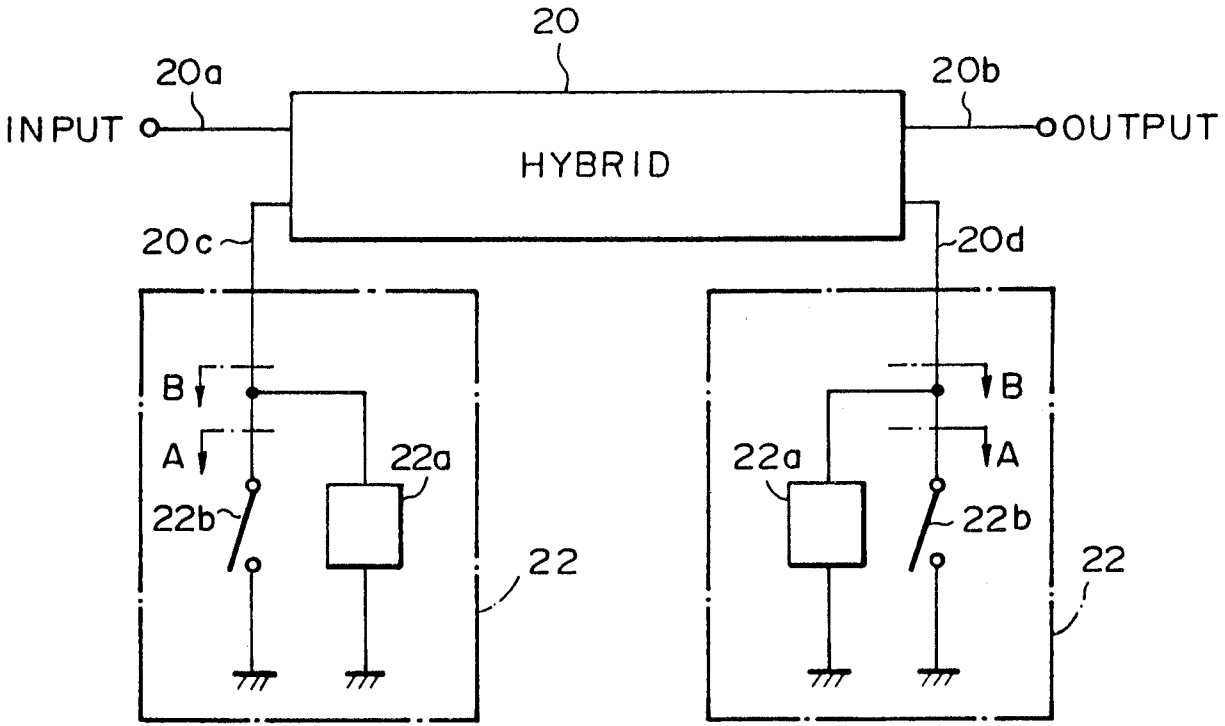
FIG. 1 is a block diagram of a phase shifter constructed in accordance with the present invention.

Referring to FIG. 1, the admittance of the circuit as viewed from a reference plane B is shown to be a sum of an admittance of the switch 22b as viewed from a reference plane A and an admittance $jY00 \cot(2\pi d/\lambda)$ of the distributed constant line 22a having one short-circuited end. As a result, the characteristic impedance Z00 of the distributed constant line 22a increases. In other words, the frequency of the admittance in the circuit as viewed from the reference plane B, that is, the change associated with the change in the wavelength λ decreases as the characteristic admittance Y00(=1/Z00) decreases. If the characteristic impedance of the distributed constant line 22a is increased, therefore, the amount of phase shift will also be less changed since the change of the admittance due to the change of the frequency is less.

If the distributed constant line 22a is reduced in thickness and the characteristic impedance thereof is decreased in such a manner, the amount of phase shift will be less changed by the changed frequency to increase the frequency band width.

This effect is saturated as the characteristic impedance becomes equal to about 10Ω. From this fact, it is understood that if the characteristic impedance is equal to or more than about 100Ω, the frequency band width can be increased sufficiently. In this regard, this is true for other phase shifters other than the 90° phase shifter. It is thus desirable that the distributed constant line 22a has its characteristic impedance equal to or more than 100 Ω.

In such an arrangement, further, the characteristics of the phase shifter is improved to have a reflection coefficient Γ Bon as viewed from the reference plane B when the FET switch 22b is in its ON state, which is near a point Γ = −1, as shown in FIG. 2. Thus, the difference of loss in the FET switch 22b when it is turned on and off can be reduced to decrease the limitation on the application.

In a range C (near the point Γ = 1) as shown by double-headed arrow in FIG. 2, the absolute value of a reflection coefficient ΔBoff as viewed from the reference plane B to the switch side when the FET switch 22b is turned off becomes smaller than that of the reflection coefficient ΔBoff to increase the loss in the phase shifter. This is due to the characteristics of the FET switch 22b itself. Thus, the OFF characteristic of the FET switch 22b must be improved. However, the reflection coefficient when only the FET switch 22b is turned off is not necessarily preferred, as shown in FIG. 6.

This results from any leakage of high frequency from the drain to the gate of the FET switch 22b. In the present invention, thus, the gate of the FET switch 22b is connected in series with the resistance 22c. As a result, the impedance of the FET switch 22b as viewed from the drain to the gate will increase to improve the characteristics thereof by well reflecting any leaking wave toward the gate.

In the past, the gate characteristic of the FET has been improved by connecting the gate thereof in series with a bias circuit which comprises a distributed constant line having a high characteristic impedance for the length λ/4 and a parallel capacitor connected with the distributed constant line. In such a prior art, however, the OFF characteristic of the FET switch 22b can be improved only near its designed frequency band, as seen from FIG. 6.

Figure 6:
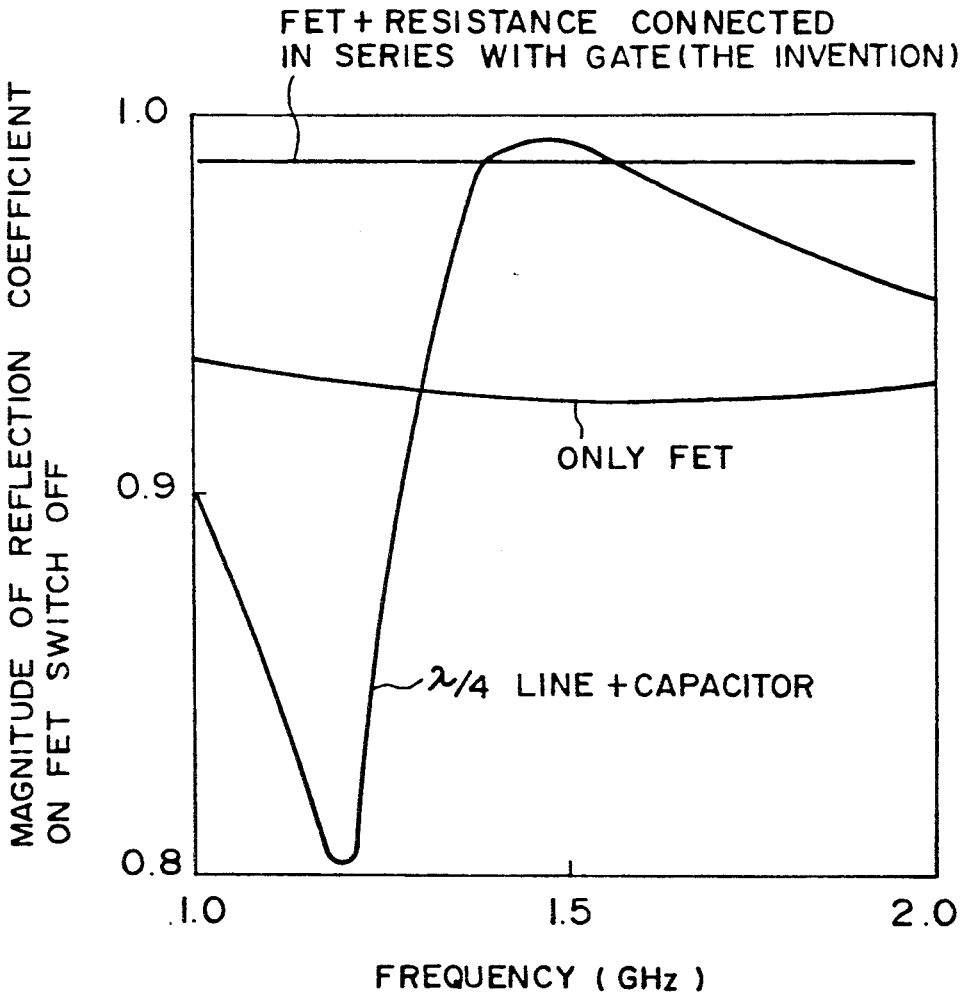
FIG. 6 is a characteristic diagram of a reflection coefficient in the FET.

On the contrary, the present invention can improve the OFF characteristic of the FET switch 22b independently of the frequency, as shown in FIG. 6.

In accordance with the present invention, the phase shifter can set the amount of phase shift at any desired level more simply since the difference between the ON and OFF characteristics is less in the widened frequency band.

EXAMPLE 1

Figure 7:
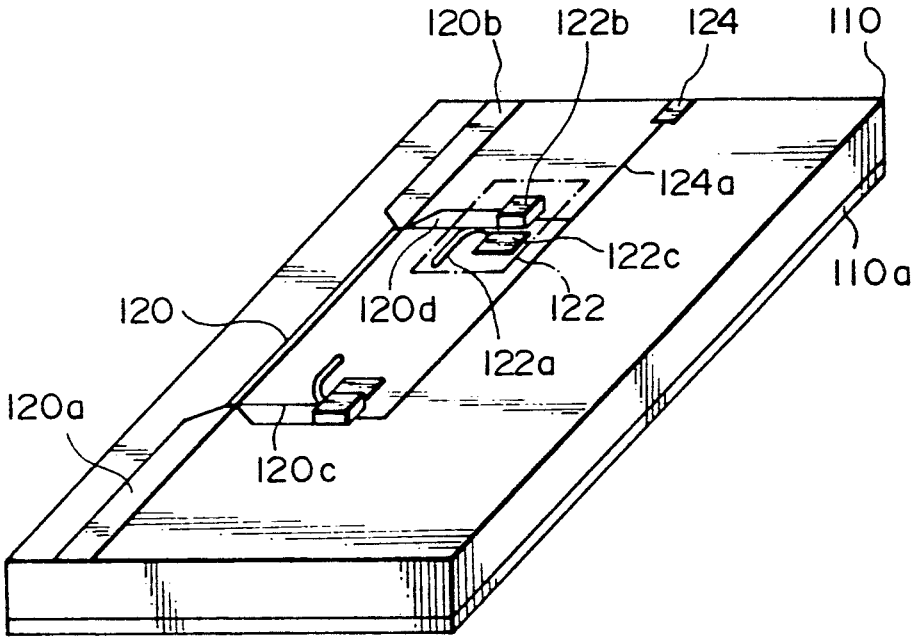
FIG. 7 is a perspective view illustrating the first embodied example of the present invention.

FIG. 7 is a perspective view showing the first embodiment of the present invention. This example uses a range coupler as hybrid element, as in FIG. 3.

In FIG. 7, a substrate 110 having a given dielectric constant includes a copper ground surface 110a formed on the backface thereof. The frontface of the substrate 110 includes a hybrid element 120 formed thereon by microstrip lines. The hybrid element 120 comprises an input terminal 120a, an output terminal 120b, a coupling terminal 120c and a through terminal 120d. The coupling and through terminals 120c and 120d are connected with phase shift regulating circuits 122, respectively.

Each of these two phase shift regulating circuits 122 comprises a distributed constant line 122a and an FET 122b. In one of the phase shift regulating circuits, the drain of the FET 122b is connected with the coupling terminal 120c while the source thereof is connected with the earth pad 122c. In the other phase shift regulating circuit, the drain of the FET 122b is connected with the through terminal 120d while the source thereof is connected with the earth pad 122c. Each of the earth pads 122c is connected with the copper ground surface 110a through through-hole means or the like.

On the other hand, the gate of each of the FET 122b is connected with a bias terminal 124 through a line 124a. The FET 122b can be turned on or off by a voltage applied to this bias terminal 124. The FET 122b contains a monolithic resistance located in a path extending from the gate pad to the gate of the FET.

In this example, the substrate 110 is made of a material having a specific inductive capacity equal to 10.2 (e.g. Trade Name Epsilum-10 or Duroid RT/6010.5) and has a thickness equal to 1.27 mm.

On the other hand, several distributed constant lines 122a were made of various lines having the same width equal to 50 microns but of different lengths. In each of phase shifts so formed, the gate of each FET 122b is connected in series with a resistance in the line 124a extending from the bias terminal 124 to the gate of the FET 122b. Thus, the phase shifter comprises only a wiring pattern for applying a bias simultaneously to the two FET's without use of any bias circuit which comprises a ¼ wavelength line and capacity as generally used in the art.

Figure 8:
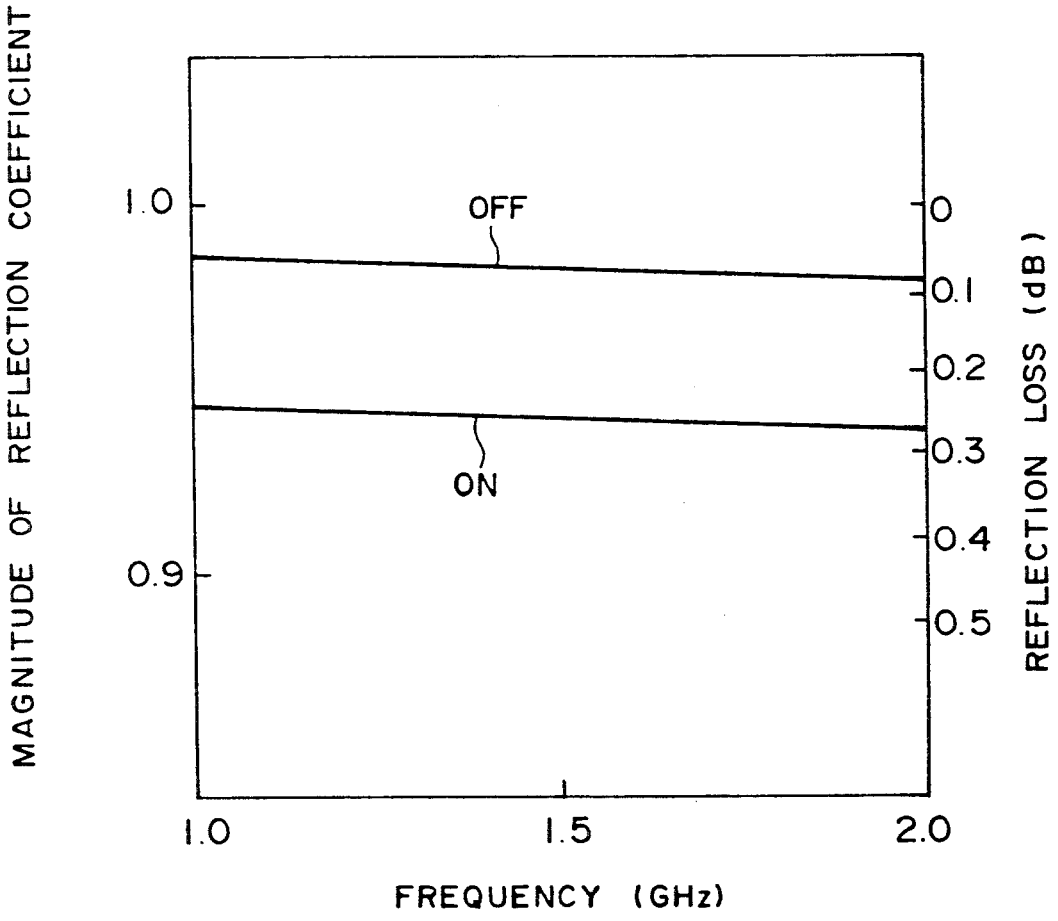
FIG. 8 is a characteristic diagram illustrating the reflection coefficient of the FET used.

The reflective characteristic between the source and drain of an FET 122b used in this example is shown in FIG. 8. Since the monolithic resistance is used herein, the absolute value of the reflection coefficient when the FET 122b is turned off inhibits a good value substantially equal to 1.0 between 1 GHz and 2 GHz and further through a widened frequency band width. On the other hand, the absolute value of the reflection coefficient on the ON state of the FET switch 122b will be slightly smaller than the above absolute value, that is, equal to 0.94 which is calculated from the value 2Ω of the ON resistance.

In the conventional phase shift regulating circuits which have not been investigated sufficiently, it was ordinary that differential loss of reflection between the ON and OFF states directly influences the characteristics of the phase shifter. In order to overcome this influence from the differential loss of reflection, a technical perception and trial and error were required.

In accordance with the present invention, however, the reflection coefficient on the ON state of the FET can be increased by regulating the length of the distributed constant line 122*a* when the amount of phase shift is to be adjusted. Any difference between the ON and OFF characteristics can be negated easily.

Figure 9:
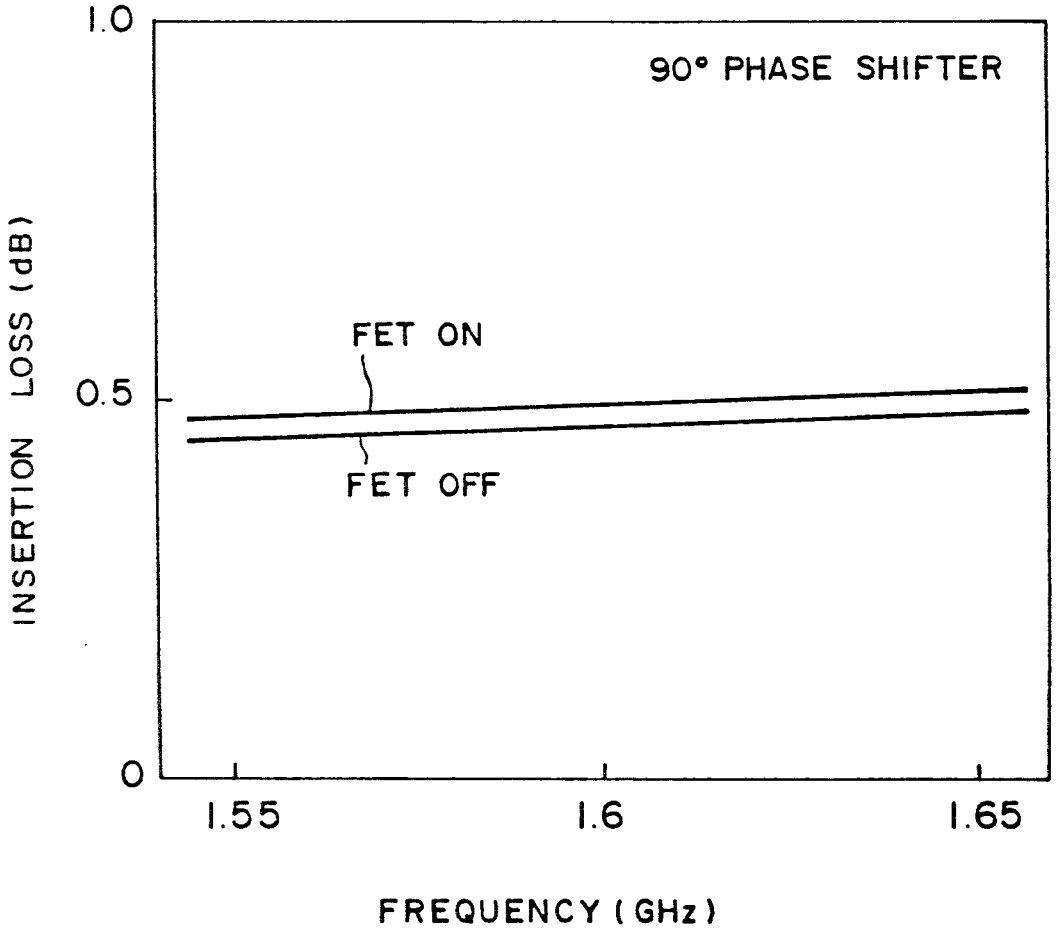
FIG. 9 is a characteristic diagram illustrating loss in a 90° phase shifter.

FIG. 9 shows the magnitude of loss in the 90° phase shifter between 55 GHz and 1.65 GHz. At 1.6 GHz, the magnitude of loss is equal to 0.49 dB on the ON state of the FET and to 0.46 dB on the OFF state of the FET. A difference between these values is only 0.03 dB. This means that the phase shifter successfully negates the differential loss between the ON and OFF states in the FET 122*b*.

In accordance with the illustrated example, a phase shifter having any desired amount of phase shift is provided by suitably selecting the length of the distributed constant line 122*a* which is located in parallel between the source and drain of the FET 122*b*.

Figure 10:
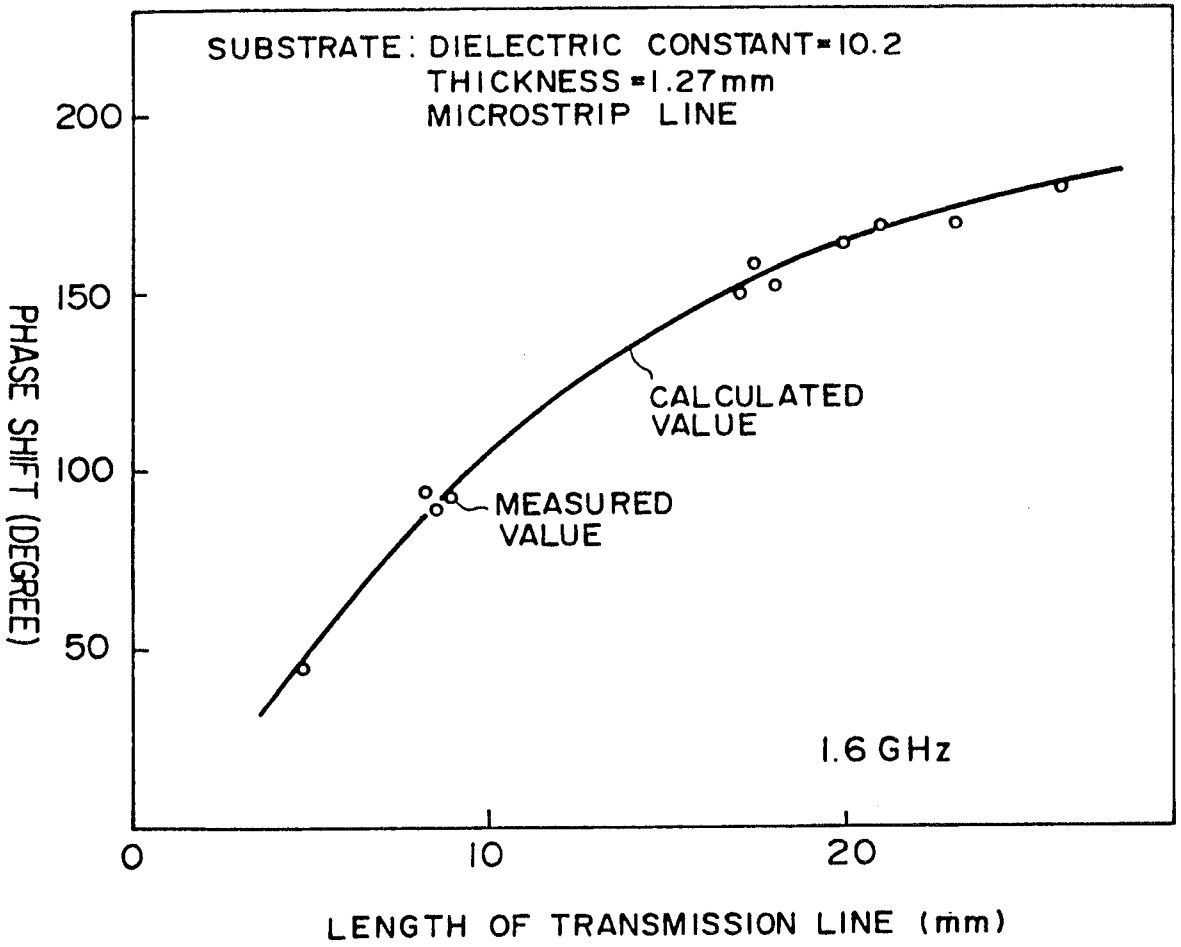
FIG. 10 is a characteristic diagram illustrating the relationship between the length and the amount of phase shifter in the distributed constant line.

FIG. 10 shows variations in the amount of phase shift in the phase shifter when the length of the distributed constant line is varied into various values. In this example, the amount of phase shift can be changed between 0° and 180° at the frequency 1.6 GHz by selecting the length of the distributed constant line 122*a* on the substrate 110 between 0 and 30 mm. The length of the distributed constant line 122*a* depends on the dielectric constant, thickness or design frequency band of the substrate 110. Even in such a case, the present invention can provide any desired amount of phase shift.

Figure 11:
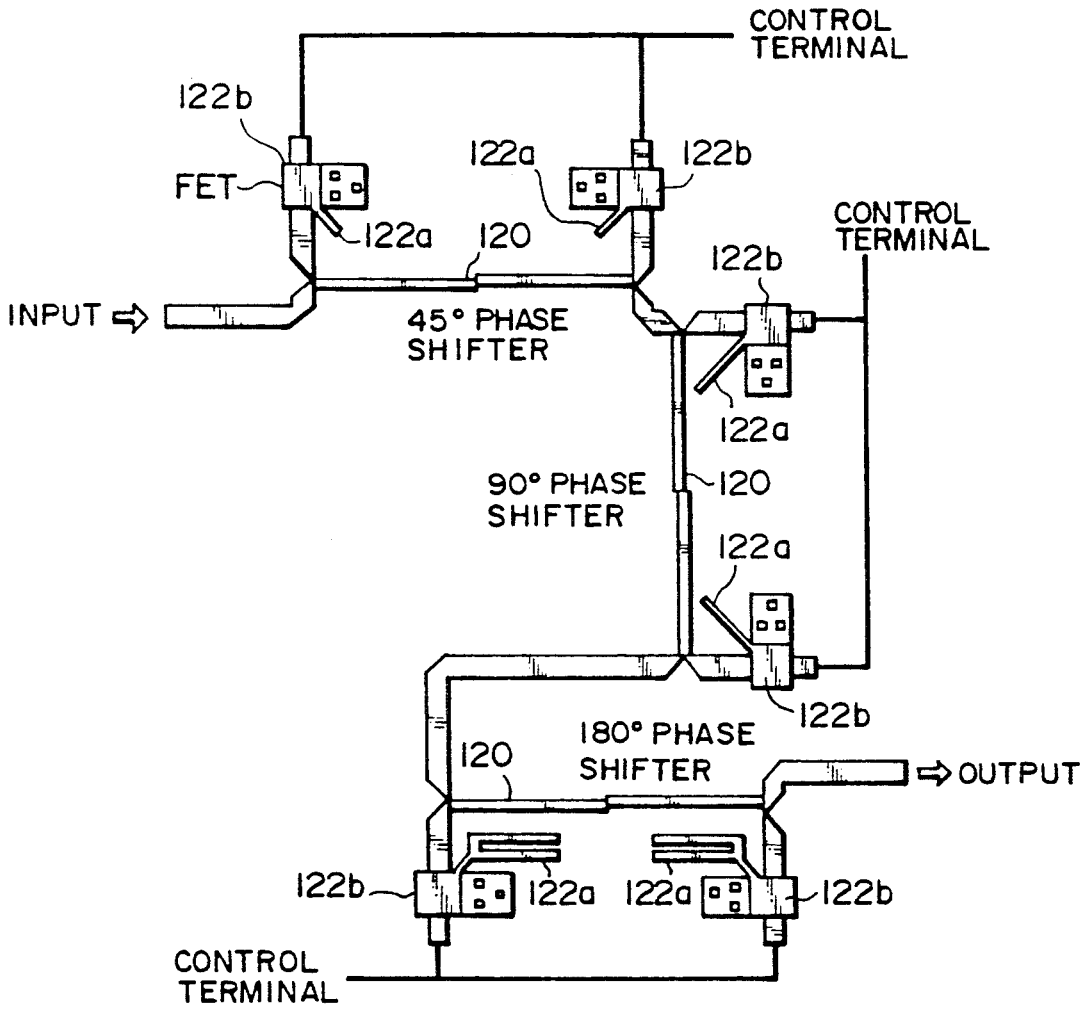
FIG. 11 is a view showing the three-bit phase shifter in the first embodiment of the present invention.
Figure 12:
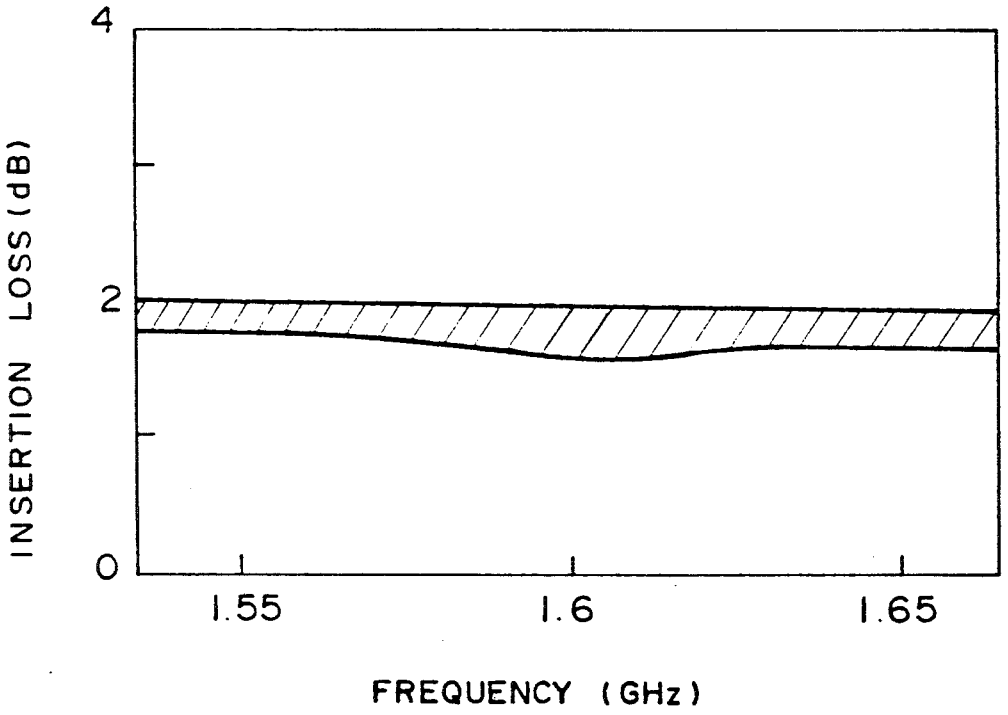
FIG. 12 is a characteristic diagram illustrating loss in the three-bit phase shifter.
Figure 13:
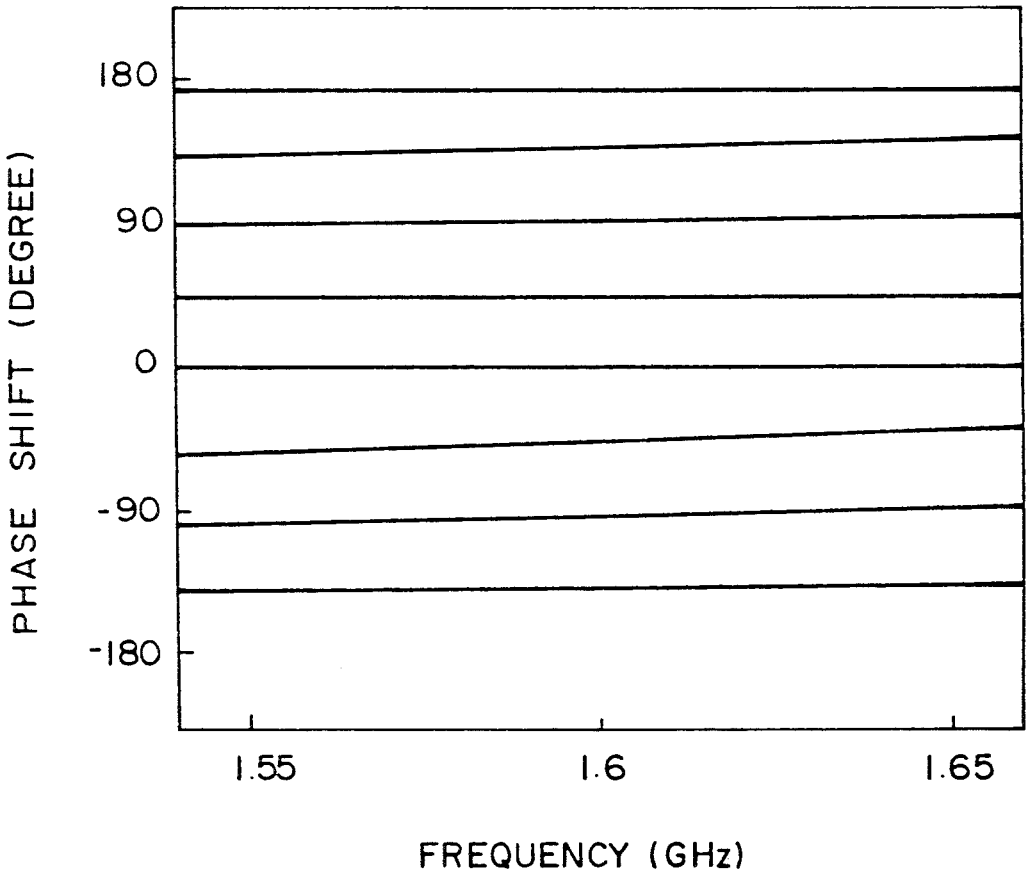
FIG. 13 is a characteristic diagram illustrating the phase shift characteristic of the three-bit phase shifter.

FIG. 11 shows a phase shifting system which comprises three 45°, 90° and 180° phase shifters connected together in series and can provide any desired amount of phase shift for each 45° till 360° (referred to "a three-bit phase shifting system). These phase shifters used herein were constructed in accordance with the principle of the present invention. The loss and phase shift in the three-bit phase shifting system are shown in FIGS. 12 and 13, respectively.

From these figures, it will be apparent that the loss is in a good level between 1.7 dB and 2.0 dB with a very small range equal to 0.3 dB. The amount of phase shift ranges within ±10° between 1.54 GHz and 1.66 GHz, providing a sufficiently widened frequency band.

EXAMPLE 2

Figure 14:
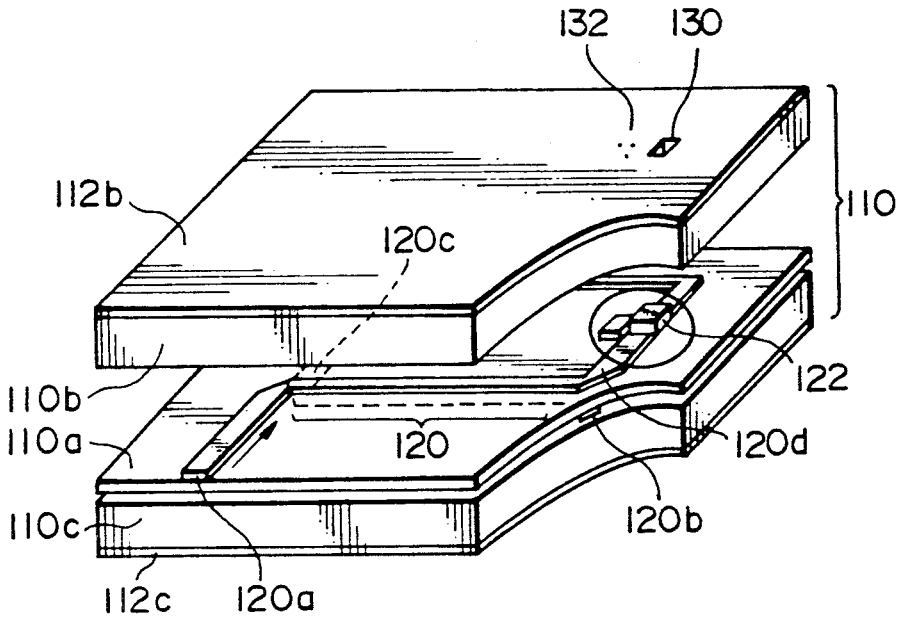
FIG. 14 is a view illustrating the arrangement of the second embodiment of the present invention.

FIG. 14 shows an example 2 according to the present invention. Each of FET's 122*b* is the same as in the first example. This example is consisted of tri-plate strip lines.

In other words, a substrate 110 comprises a substrate component 110*a* having a specific inductive capacity of 2.2 and a thickness of 0.127 mm and substrate components 110*b* and 110*c* each having a specific inductive capacity of 2.2 and a thickness of 0.787 mm. The outside face of each of the substrates 110*b* and 110*c* is formed with a copper ground surface layer 112*b* or 112*c*. These substrate components are made of a material commercially available as trade name, Duroid RT/5880.

The substrate component 110*a* includes wiring patterns formed therein at the opposite sides. One of the wiring patterns defines a hybrid element 120 on the front side of the substrate component 110*a*, which in turn defines a 3 dB coupler consisting of broad side offset coupled lines. The front face of the substrate component 110*a* includes an input terminal 120*a* and a through terminal 120*d* while the back face thereof includes an output terminal 120*b* and a coupling terminal 120*c*.

A phase shift regulating circuit 122 comprises an FET 122*b* and a distributed constant line 122*a*, as in the example 1.

Figure 14A:
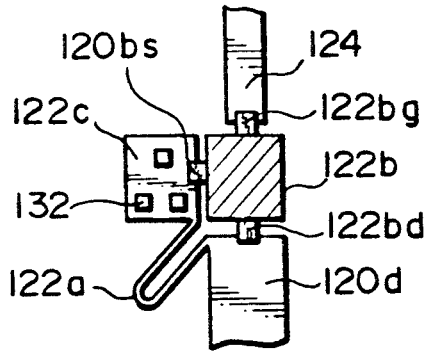
FIG. 14A is an enlarged plan view showing the primary parts of the second embodiment of the present invention.

FIG. 14A shows an enlarged plan view of the phase shift regulating circuit 122 (which comprises the FET 122*b* and the distributed constant line 122*a*) encircled by a circle in FIG. 14 and connected with the through terminal 120*d* of the hybrid element 120. The FET 122*b* includes three terminals, that is, a source 122*bs*, a drain 122*bd* and a gate 122*bg*. The drain 122*bd* is connected with the through terminal 120*d* of the hybrid element 120. The source 122*bs* is connected with an earth pad 122*c* while the gate 122*bg* is connected with a line 124*a* which in turn is connected with the bias terminal 124.

Another phase shift regulating circuit formed on the backside of the substrate component 110*a* comprises an FET 122*b*, the drain 122*b* of which is connected with a similar hybrid element 120 formed by the other wiring pattern at the coupling terminal 120*c* of the hybrid element 120. The source of the FET 122*b* is connected with an earth pad 122*c* which in turn is connected with the copper ground surface layers 112*b* and 122*c* through through-holes 132.

Since this circuit is formed of tri-plate strip lines, the substrate component 110*a* is sandwiched between the substrate components 110*b* and 110*c*. In order to receive the thickness of the FET 122*b*, the substrate component 110*b* includes an opening 130 formed therein. Furthermore, the perfect grounding to the earth pad 122*c* can be provided by the through-holes 132 formed in the substrate components 110*a*, 110*b* and 110*c*.

Figure 15:
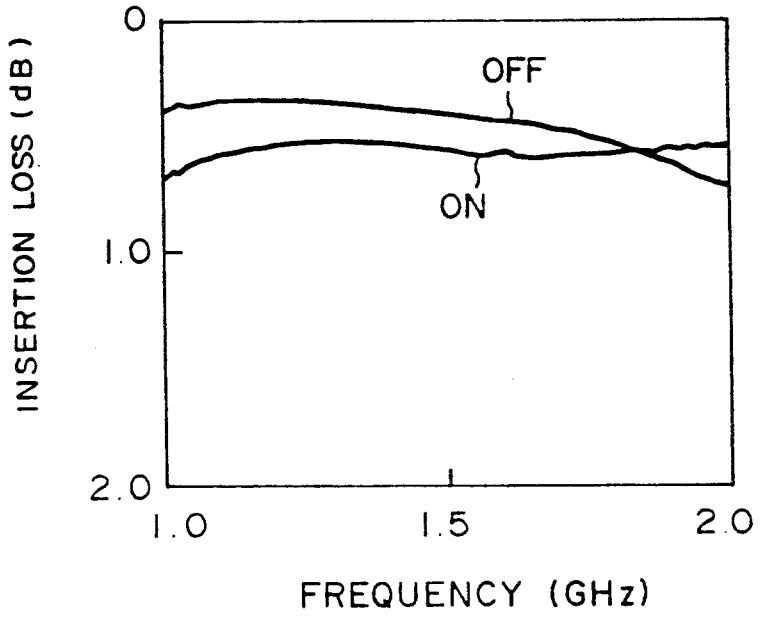
FIG. 15 is a characteristic diagram illustrating loss in the 90° phase shifter.

Insertion loss in a 90° phase shifter constructed according to the present invention is shown in FIG. 15.

At 1.6 GHz, the insertion loss becomes equal to 0.58 dB on the ON state of the FET and to 0.43 dB on the OFF state of the FET with a difference therebetween being equal to 0.15 dB which is small. The amount of loss itself also is small. This fact means that the present invention can provide good characteristics in phase shifter.

Figure 16:
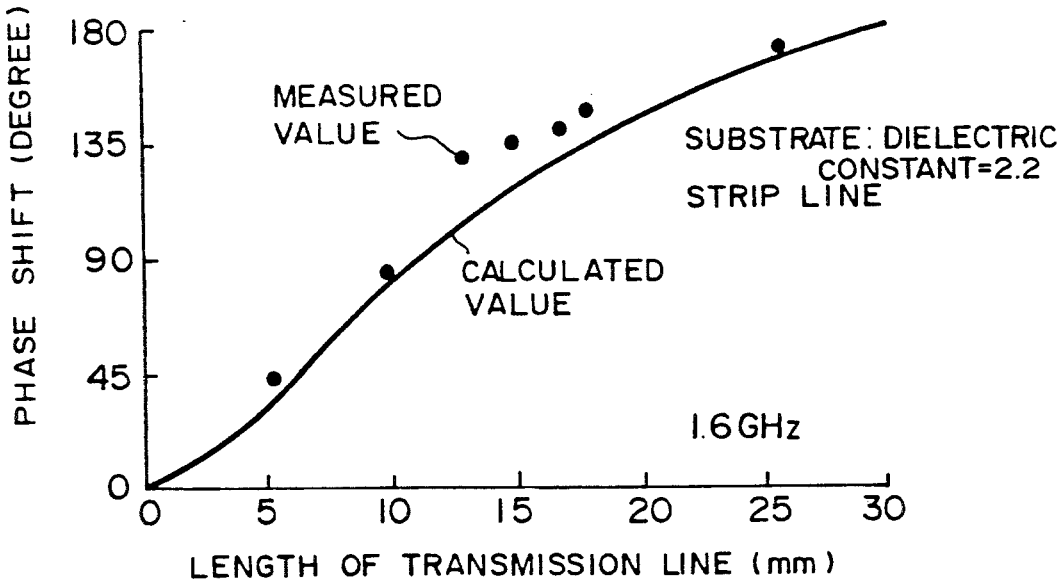
FIG. 16 is a characteristic diagram illustrating the relationship between the length and the amount of phase shift in the distributed constant line.
Figure 17:
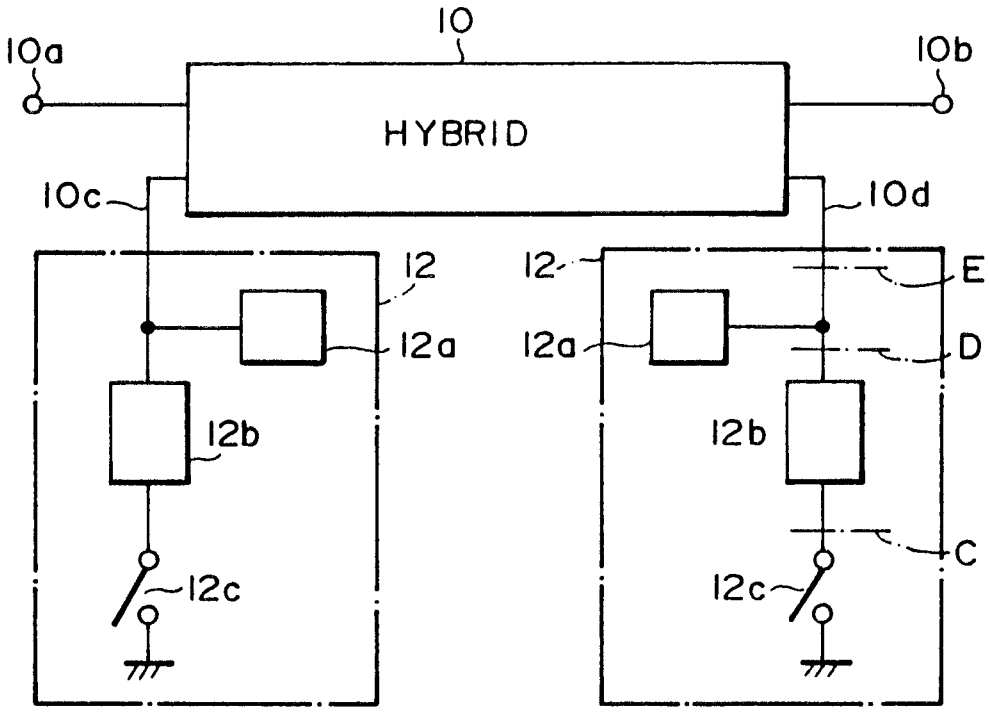
FIG. 17 PRIOR ART
FIG. 17 is a block diagram illustrating the arrangement of a prior art phase shifter.
Figure 18:
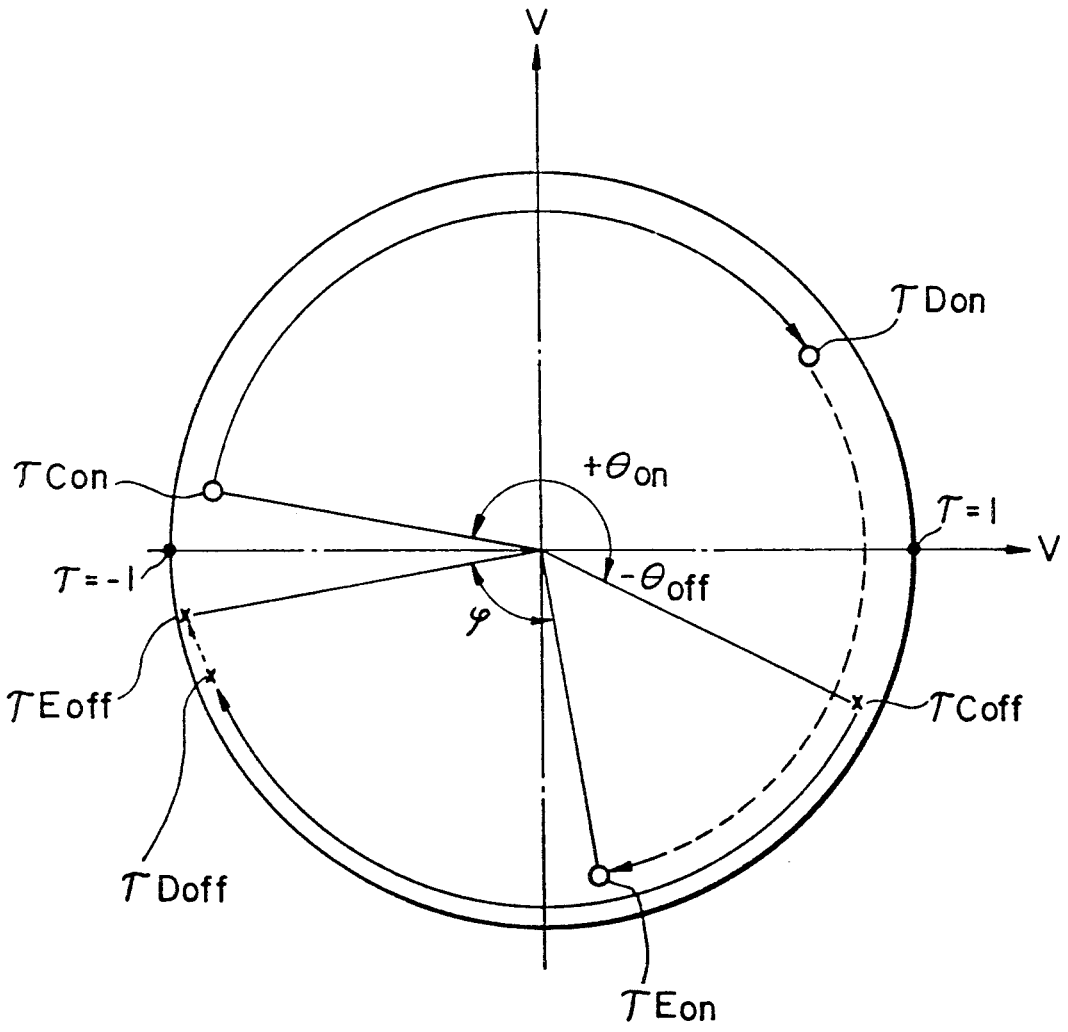
FIG. 18 (PRIOR ART)
FIG. 18 is a characteristic diagram illustrating the functional principle of the prior art phase shifter.
Figure 19:
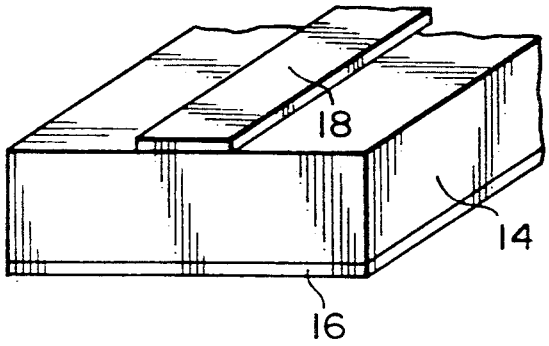
FIG. 19 is a view of a microstrip line.
Figure 20:
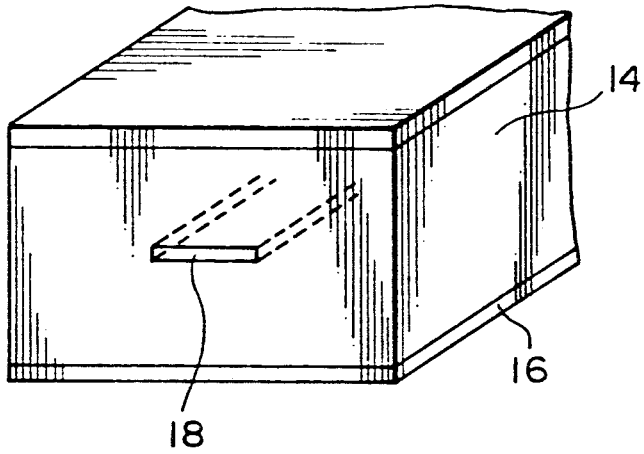
FIG. 20 is a view of a tri-plate strip line.

The relationship between the length of the distributed constant line and the amount of phase shift in this example is shown in FIG. 16. Similarly, the phase shifter can change the amount of phase shift to 180° in a range equal to or smaller than 30 mm. It was found that the advantages of this example are similar to the microstrip line type.

We claim:

1. A phase shifter comprising:

a hybrid element for phase shifting an input signal and for outputting a phase shifted signal;

a switch connected with said hybrid element for providing a given change to an amount of phase shift in said hybrid element; and a distributed constant line connected in parallel with said switch and having a preselected characteristic impedance, whereby the amount of phase shift in said hybrid element can be selected by turning said switch on or off;

wherein said hybrid element includes an input terminal for receiving a signal, a through terminal electrically connected directly with said input terminal, a coupling terminal capacitive coupled with said input terminal, and an isolation terminal capacitive coupled with said input terminal and for providing an output signal.

2. A phase shifter as defined in claim 1 wherein said switch and distributed constant line include a first switch and distributed constant line which connect said coupling terminal with earth and a second switch and distributed constant line which connect said through terminal with earth.

3. A phase shifter as defined in claim 2 wherein said switch comprises a FET.

4. A phase shifter as defined in claim 2 wherein said distributed constant line is of a microstrip line type in which electrically conductive lines are formed on a dielectric substrate.

5. A phase shifter as defined in claim 2 wherein said distributed constant line is of a tri-plate line type in which electrically conductive lines are formed on a dielectric substrate.

6. A phase shifter as defined in claim 2 wherein said hybrid element is of a range coupler type in which a plurality of conductors are arranged close to each other and capacitive coupled together on a dielectric substrate.

7. A phase shifter as defined in claim 6 wherein said switch comprises a FET.

8. A phase shifter as defined in claim 2 wherein said hybrid element is of a broad side offset type in which a plurality of conductors are arranged close to each other and capacitive coupled together on the opposite sides of a dielectric substrate.

9. A phase shifter as defined in claim 8 wherein said switch comprises a FET.

* * * * *